US007396055B2

(12) United States Patent
Arneson et al.

(10) Patent No.: US 7,396,055 B2
(45) Date of Patent: Jul. 8, 2008

(54) SECURITY STRIKE PLATE

(76) Inventors: Christopher L. Arneson, P.O. Box 1112, Marcola, OR (US) 97454; Todd M. Quint, P.O. Box 42294, Eugene, OR (US) 97404

( * ) Notice: Subject to any disclaimer, the term of this patent is extended or adjusted under 35 U.S.C. 154(b) by 60 days.

(21) Appl. No.: 11/295,121

(22) Filed: Dec. 5, 2005

(65) Prior Publication Data

US 2007/0096480 A1 May 3, 2007

Related U.S. Application Data

(60) Provisional application No. 60/732,186, filed on Oct. 31, 2005.

(51) Int. Cl.
*E05B 15/02* (2006.01)

(52) U.S. Cl. ..... 292/340; 292/346; 52/213

(58) Field of Classification Search ..... 292/340, 292/341, 341.12, 341.13, 341.14, 346; 52/213
See application file for complete search history.

(56) References Cited

U.S. PATENT DOCUMENTS 2,259,766 A * 10/1941 Murphy ..... 292/198
4,802,701 A * 2/1989 Mazie ..... 292/340
4,809,400 A 3/1989 Allen
4,854,621 A * 8/1989 Baldwin ..... 292/340
5,088,780 A 2/1992 Doherty
5,934,024 A * 8/1999 Simpson ..... 49/462

* cited by examiner

*Primary Examiner*—Gary Estremsky
(74) *Attorney, Agent, or Firm*—Robert E. Howard

(57) ABSTRACT

A security strike plate comprising a strike plate portion adapted to receive a locking bolt and a security member. The security member includes a ceiling having an outer surface and an inner surface, an outer side wall extending downwardly from the ceiling, and a floor extending inwardly from the outer side wall. The ceiling is located in the same plane as the strike plate portion and is an extension thereof. The ceiling and the floor are substantially parallel. An inner side wall can extend upwardly from the floor substantially parallel to the outer side wall, the inner side wall having an outer end that abuts against the inner surface of the ceiling. The ceiling and floor having openings therein adapted to receive an elongated anchor member therethrough.

12 Claims, 3 Drawing Sheets

SECURITY STRIKE PLATE

CROSS-REFERENCE TO RELATED APPLICATIONS

This application claims the benefit of U.S. Provisional Application No. 60/732,186, filed Oct. 31, 2005.

BACKGROUND OF THE INVENTION

The present invention relates to a security strike plate that secures an entry door against being kicked in by virtue of strike plate failure during an attempted forcible entry.

Typical commercially available strike plates are attached to door jambs by wood screws, and have an opening through which the lock bolt of a keyed lockset or the dead bolt of a dead bolt installation passes into a receptacle carved out of the door jamb. When closed and locked, the outer vertical edge of the entry door rests against a door stop which can be a separate piece of wood attached to the door jamb, or the door stop and jamb milled from a single piece of wood. Typically the only thing securing the strike plate to the door jamb are two wood screws passing through openings in the strike plate located above and below the bolt receiving opening. Since the door stop is located on the exterior side of the door and strike plate, it provides no resistance to a door being forced inwardly from the outside. It is common for someone wishing to break into a dwelling through an entry door to merely kick the door until the screws securing the strike plate, or the door jamb to which the strike plate is attached, give way and the door is forced open.

The prior art has suggested a number of security means for preventing the wood screws of the strike plate from giving way during forced entry. Many employ additional wood screws which provide little added protection.

One device, described in U.S. Pat. No. 5,088,780, describes a security lock-keeper plate which can be used in conjunction with an existing strike plate or alone. A lower face plate forms the strike plate portion and an upper face plate, connected to the lower face plate by a center section adapted to seat against the edge of a door stop rail, rests against the outer face of the door stop. The upper face plate is attached to the wall studs by means of a large screw. However, the screw head can be dislodged from the upper face plate during forcible entry, and since the screw head is located on the outside of the door it can be accessed and removed by someone attempting a forced entry.

U.S. Pat. No. 4,809,400 describes a strike plate formed from a blank having a portion like conventional strike plates, and a tab extending from the conventional strike plate portion that can be folded to form a U-shaped member having aligned apertures for receiving a buck pin. The U-shaped member is inserted into a notch cut into the door stop. However, the head of the buck pin is on the outside of the door and can be accessed and removed by someone attempting a forced entry. In addition, to install this device the code required weather-stripping that fits into a slot at the juncture of the door stop and door jamb would have to be cut away to accommodate the device, thereby compromising the integrity of the weather-stripping.

SUMMARY OF THE INVENTION

It is an object of the present invention to provide a security strike plate that secures an entry door against being kicked in by virtue of strike plate failure during an attempted forcible entry.

The security strike plate has a strike plate portion adapted to receive a locking bolt and a security member. The security member includes a ceiling having an outer surface and an inner surface, an outer side wall extending downwardly from the ceiling, a floor extending inwardly from the outer side wall. Preferably an inner side wall extends upwardly from the floor. The ceiling is located in the same plane as the strike plate portion and is an extension thereof. The ceiling and the floor are substantially parallel, and the inner side wall and the outer side wall are substantially parallel and substantially perpendicular to the ceiling and floor. The inner side wall has an outer end that abuts against the inner surface of the ceiling. The ceiling and floor have aligned anchor member receiving openings therein adapted to receive an anchor member therethrough.

In use, the security member is positioned within a notch incised within a door jamb in an area adjacent to the door stop. A pilot hole in alignment with the anchor member openings is drilled through the door jamb and through the trimmer stud and king stud. An anchor member is inserted through the anchor member openings and screwed into and through the trimmer stud and king stud. The anchor member has a threaded portion and a non-threaded portion. The non-threaded portion has a length adapted to cause the juncture of the non-threaded portion and threaded portion to be located within the trimmer stud.

DESCRIPTION OF PREFERRED EMBODIMENTS

Figure 1:
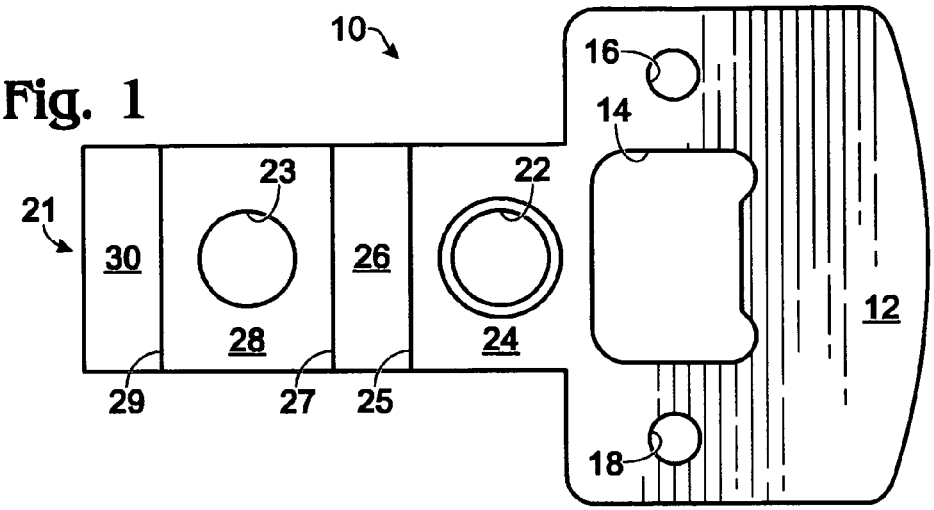
FIG. 1 is a top plan view of a blank used for forming the security strike plate of the present invention for use with keyed locksets.

Security strike plate blank 10, shown in FIG. 1, includes a strike plate portion 12 having a keyed lockset bolt receiving opening 14 and screw holes 16 and 18 for receiving wood screws to be attached to a door jamb. The structure of strike plate portion12 shown in FIG. 1 is one type of a conventional type strike plate structure used in conjunction with keyed locksets. However, any strike plate structure used in conjunction with keyed locksets may be substituted for strike plate portion 12 illustrated in FIG. 1.

Extending rearwardly and downwardly from strike plate portion 12 is a security member 20. Security member 20 is formed from tab 21 of security strike plate blank 10. Tab 21 is in the same plane as strike plate portion 12 and is an extension thereof. Tab 21 has a width less than the width of strike plate portion 12, preferably about fifty percent thereof. Tab 21 preferably extends rearwardly from a central portion of strike plate portion 12, as shown. Tab 21 has anchor member openings 22 and 23, each having a diameter adapted to receive a cylindrical anchor member 60 therethrough. Anchor member opening 22 is beveled inwardly.

To form the security strike plate 40 of the present invention, tab 21 is bent downwardly 90 degrees along crease line 25, bent inwardly 90 degrees along crease line 27, and upwardly along crease line 29.

Figure 4:
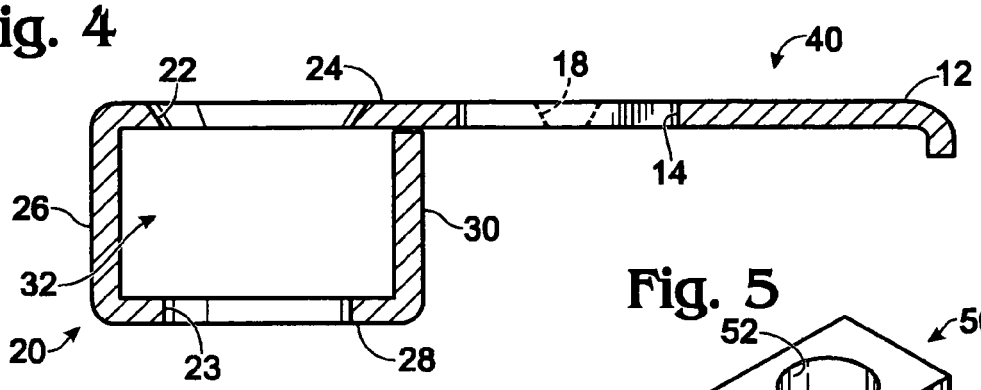
FIG. 4 is a side elevational view of the security strike plate, taken along line 4-4 of FIG. 3.
Figure 5:
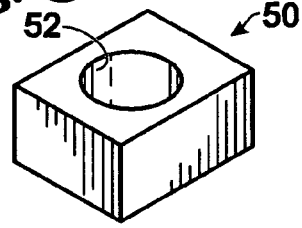
FIG. 5 is a perspective view of a shock absorbing member that can be used with the security strike plate.

That portion of tab 21 located between strike plate portion 12 and crease line 25 forms the ceiling 24 of security member 20. That portion of tab 21 located between crease lines 25 and 27 forms the outer side wall 26 of security member 20. That portion of tab 21 located between crease lines 27 and 29 forms the floor 28 of security member 20. That portion of tab 21 located outwardly of crease line 29 forms the inner wall 30 of security member 20. The upper, outer end of inner wall 30 abuts the underside of ceiling 24, as shown in FIGS. 4 and 6.

Ceiling 24, outer side wall 26, floor 28 and inner side wall 30 form an open ended rectangular channel 32. The position of anchor member openings 22 and 23 on tab 21, and the location of the crease lines 25, 27, and 29, are such that anchor member openings 22 and 23 are in alignment, i.e., have centers located on a common longitudinal axis, as shown in FIGS. 4 and 6.

Figure 6:
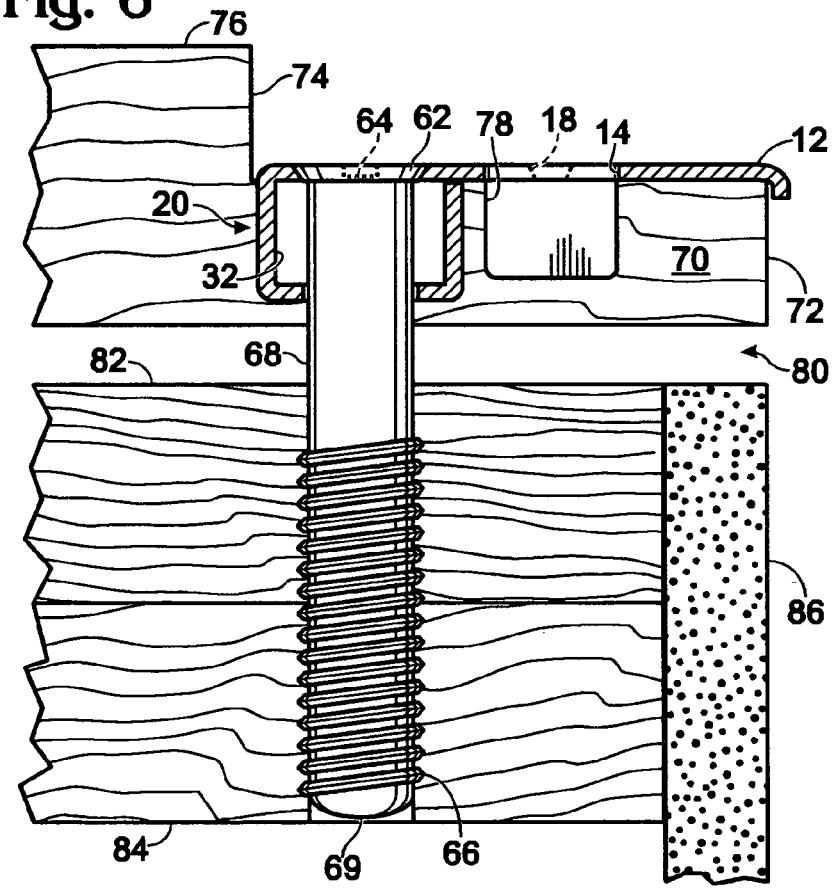
FIG. 6 is a sectional view showing the security strike plate in its installed configuration.
Figure 7:
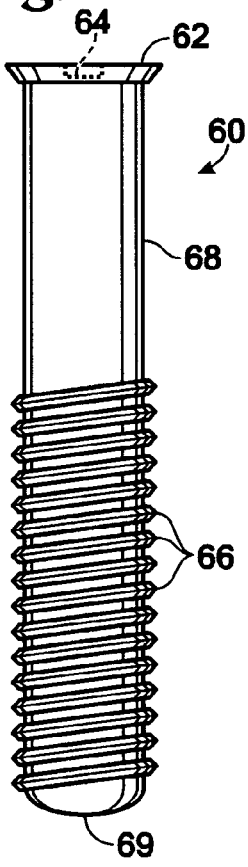
FIG. 7 is a side elevational view of the preferred anchor member used to secure the security strike plate to the door jamb and adjacent structure.

The dimensions of the various elements of security strike plate 40 are such that the entire security strike plate 40 is located on the inner side of stop rail 76, and preferably the outer surface of outer side wall 26 is in the same plane as the inner edge 74 of stop rail 76, as shown in FIG. 6. Where the outer surface of outer side wall 26 is in the same plane as the inner edge 74 of stop rail 76, and in abutment therewith prior to security strike plate 40 being affixed to door jamb 70, bolt receiving opening 14 is accurately positioned for use as a template for the bolt receiving opening 78 to be formed in the door jamb. The entire security strike plate 40 being located inside stop rail 74 prevents access to anchor member 60 by someone standing outside the door.

Figure 2:
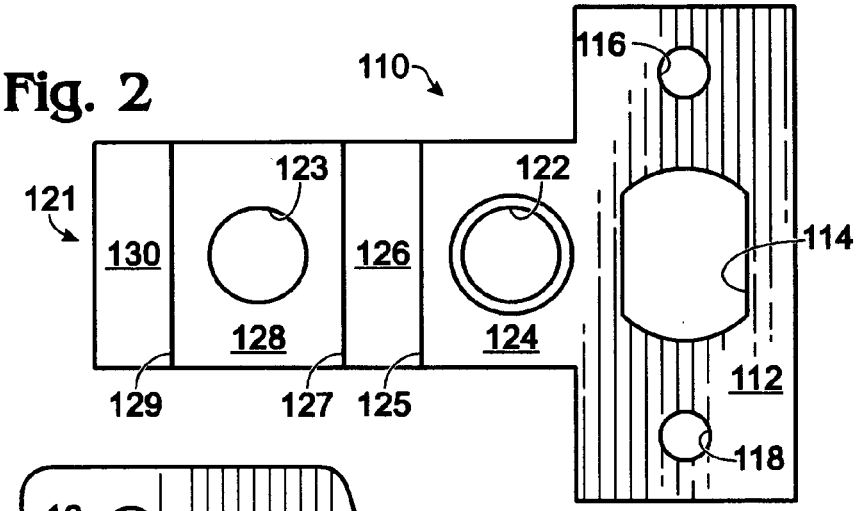
FIG. 2 is a top plan view of a blank used for forming the security strike plate for use with dead bolts.
Figure 3:
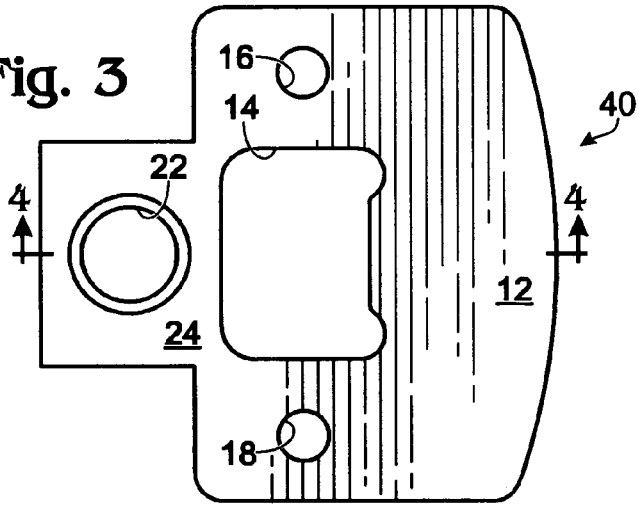
FIG. 3 is a top plan view of the security strike plate formed from the security strike plate blank of FIG. 1.

FIG. 2 shows a security strike plate blank 110 that includes a strike plate portion 112 having a dead bolt receiving opening 114 and screw holes 116 and 118 for receiving wood screws to be attached to a door jamb. The structure of strike plate portion 112 is one type of a strike plate structure typically used in conjunction with dead bolts. However, any strike plate structure used in conjunction with deadbolts may be substituted for the strike plate portion 112 illustrated in FIG. 2. The structure of security member portion 121 is identical to security member portion 21, and the elements of security member portion 121 have the same reference numbers as the elements of security member portion 21 but increased by 100. Security strike plate blank 110 is formed into a security strike plate in a manner identical to that used to transform security strike plate blank 10 into security strike plate 40.

The dimensions of the various elements of security strike plate blank 110 are such that, when formed into a security strike plate, the entire security strike plate formed therefrom is located on the inner side of stop rail 76, and preferably the outer surface of outer side wall 126 is in the same plane as the inner edge 74 of stop rail 76. Where the outer surface of outer side wall 126 is in the same plane as the inner edge 74 of stop rail 76, and in abutment therewith prior to the security strike plate formed from blank 110 being affixed to door jamb 70, bolt receiving opening 114 is accurately positioned for use as a template for the bolt receiving opening 78 to be formed in the door jamb, and to thereby cause bolt openings 14 and 114 to be accurately positioned in alignment where both a keyed lockset and a deadbolt are present.

Herein whenever there is a reference to "bolt", it is intended to include both the type of bolt used with locksets and the type of bolt used with dead bolts.

A shock absorbing member 50 is the same size as channel 32 or 232, and is adapted to be inserted therein. A cylindrical opening 52 extends therethrough and, when shock absorbing member 50 is positioned within channel 32 or 232, is of a diameter adapted to allow anchor member 60 to be passed therethrough. Shock absorbing member 50 can be formed of any resilient material, such as rubber or other natural or synthetic elastomers.

Anchor member 60 has a beveled head 62 adapted to be seated in beveled anchor member opening 22 of security member 20. An opening 64 in beveled head 62 is adapted to receive an Alan head wrench. However, other slots or openings for receiving other types of screwing tools, such as screwdrivers, can be used. Anchor member 60 has a threaded portion 66 and a non-threaded portion 68. A bullnose tip 69 is located at the outer end of anchor member 60 to prevent damage to internal wiring during installation of security strike plate 40.

To install security strike plate 40, it is placed against door jamb 70 in the area between the inner edge 72 thereof and the inner edge 74 of door stop 76. A marker is used to outline locking bolt receiving opening 14, 114, or 214. A locking bolt receiving channel 78 is then incised in door jamb 70 within the boundary of the outline. Channel 78 is adapted to receive a locking bolt in a manner well known in the art.

Likewise, a marker is used to inscribe the periphery of security member 20 on the door jamb, and an opening of a size adapted to receive security member 20 is incised in door jamb 70. Security member 20 is then inserted into that incised opening with the lower surface of strike plate portion 12 flush against the outer surface of door jamb 70, as shown in FIG. 6. Strike plate portion 12 is affixed to door jamb 70 with woodscrews passed through openings 16 and 18. A pilot hole to receive anchor member 60 is drilled through the door jamb 70, trimmer stud 82 and king stud 84 using aligned openings 22 and 23 to guide the drill. Anchor member 60 is then inserted through openings 22 and 23, and screwed into, and entirely through, door jamb 70, airspace 80, trimmer stud 82 and king stud 84.

The non-threaded portion 68 of anchor member 60 occupies a sufficient portion of the length of anchor member 60, from head 62 to threaded portion 66, that it extends into the trimmer stud 80 so that a potentially weaker portion located at the juncture of the non-threaded portion 68 and the threaded portion 66 is located entirely within the trimmer stud 80. The beveled head 62 of anchor member 60 is fully seated within beveled opening 22 and is flush with the upper surface of the security strike plate 40.

An inner wall 86 is attached to studs 82 and 84, and to other studs (not shown).

Figure 8:
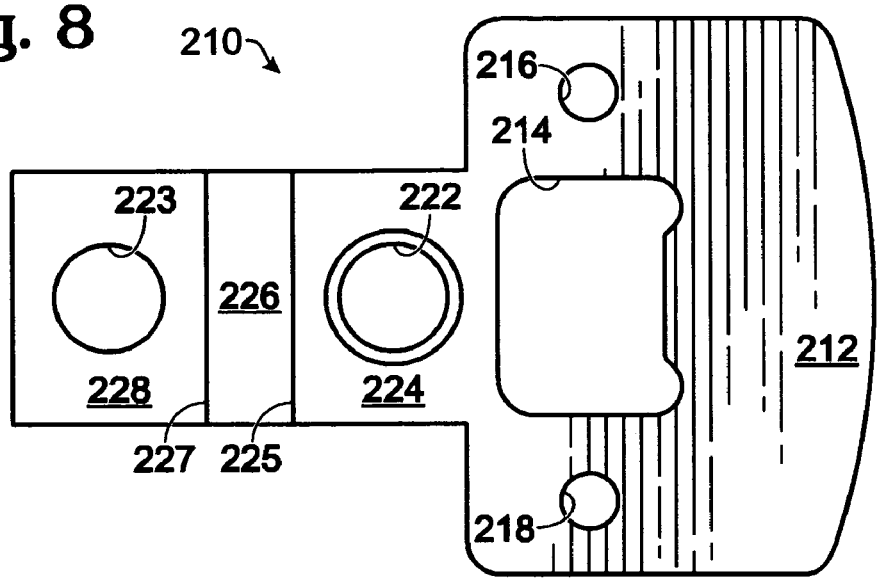
FIG. 8 is a top plan view of an alternative blank used for forming an alternative security strike plate for use with keyed locksets.

An alternative security strike plate blank 210, shown in FIG. 8, includes a strike plate portion 212 having a keyed lockset bolt receiving opening 214 and screw holes 216 and 218 for receiving wood screws to be attached to a door jamb. The structure of strike plate portion 212 is one type of a strike plate structure typically used in conjunction with keyed locksets. However, strike plate portion 212 can be structured like strike plate portion 112 of FIG. 2 for use with dead bolts, or structured like any strike plate used with locksets or deadbolts.

Extending rearwardly and downwardly from strike plate portion 212 is a security member 220. Security member 220 is formed from tab 221 from security strike plate blank 210. Tab 221 is in the same plane as strike plate portion 212 and is an extension thereof. Tab 221 preferably extends rearwardly from a central portion of strike plate portion 212, as shown. Tab 221 has a width less than the width of strike plate portion 212, preferably about fifty percent thereof. Tab 221 has anchor member openings 222 and 223, each having a diameter adapted to receive an anchor member 60 therethrough. Anchor member opening 222 is beveled inwardly and adapted to seat the beveled head 62 of anchor member 60.

Figure 9:
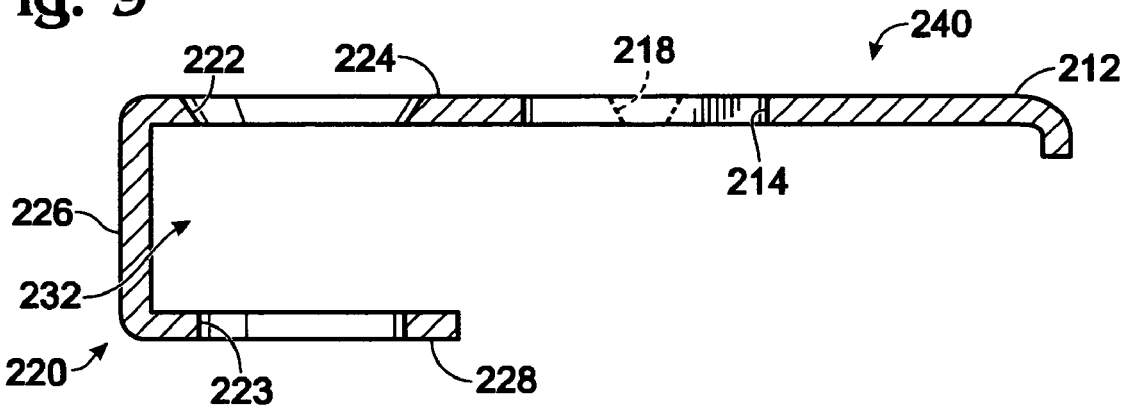
FIG. 9 is a side elevational view of the alternative security strike plate formed from the blank of FIG. 8 for use with keyed locksets.

To form the security strike plate 240 of the present invention, tab 221 is bent downwardly 90 degrees along crease line 225, and bent inwardly 90 degrees along crease line 227. That portion of tab 221 located between strike plate portion 212 and crease line 225 forms the ceiling 224 of security member 220. That portion of tab 221 located between crease lines 225 and 227 forms the outer side wall 226 of security member 20. That portion of tab 221 located outwardly of crease line 227 forms the floor 228 of security member 220. Ceiling 224, outer side wall 226, and floor 228 form an open ended C-shaped channel 232. Shock absorbing member 50 can be placed within channel 232. The position of anchor member openings 222 and 223 on tab 221, and the location of the crease lines 225 and 227, are such that anchor member openings 222 and 223 are in alignment, as shown in FIG. 9.

The dimensions of the various elements of security strike plate 240 are such that the entire security strike plate 240 is located on the inner side of stop rail 76, and preferably the outer surface of outer side wall 226 is in the same plane as the inner edge 74 of stop rail 76, in the same manner as shown in FIG. 6 relative to security strike plate 40. Where the outer surface of outer side wall 226 is in the same plane as the inner edge 74 of stop rail 76, and in abutment therewith prior to security strike plate 240 being affixed to door jamb 70, bolt receiving opening 214 is accurately positioned for use as a template for the bolt receiving opening 78 to be formed in the door jamb. The entire security strike plate 240 being located inside stop rail 74 prevents access to anchor member 60 by someone standing outside the door.

It will be obvious to those having skill in the art that many changes may be made to the details of the above-described embodiments of this invention without departing from the underlying principles thereof The scope of the present invention should, therefore, be determined only by the following claims.

The invention claimed is:

1. An entry door frame including a door jamb having an inner edge and an outer planar surface, and a stop rail having inner and outer vertical edges, said inner vertical edge of said stop rail being spaced outwardly from said inner edge of said door jamb, a security strike plate attached to said outer planar surface of said door jamb, said security strike plate comprising a strike plate portion adapted to receive a locking bolt and a security member portion, said strike plate portion having an upper and lower surface, said security member portion including a ceiling having an upper surface and a lower surface, said ceiling being located in the same plane as said strike plate portion and is an extension thereof, an outer side wall extending downwardly from the outer edge of said ceiling, a floor extending inwardly from the lower edge of said outer side wall, and an inner side wall extending upwardly from the outer edge of said floor, said ceiling and said floor being substantially parallel, said ceiling and said floor having aligned anchor member receiving openings therein adapted to receive an elongated anchor member therethrough, said ceiling, outer side wall, floor, and inner sidewall forming an open ended channel member, the lower surface of said strike plate portion being in abutment with the outer planar surface of said door jamb, said open ended channel member being positioned substantially entirely within an opening extending from the outer planar surface of said door jamb and into said door jamb, said opening being located inwardly of said inner edge of said stop rail.

2. The entry door frame of claim 1 wherein the outer surface of said outer side wall is in the same plane as the inner edge of said stop rail.

3. The entry door frame of claim 1 wherein said entry door frame is positioned within and attached to the wall framing of a building structure including a trimmer stud and a king stud adjacent thereto, and an elongated anchor member passing through said anchor member receiving openings in said ceiling and said floor of said security member portion and into and through said trimmer stud and into and through or substantially through said king stud, said anchor member being attached to at least one of said trimmer stud and said king stud.

4. The entry door frame of claim 3 wherein said anchor member is attached to both said trimmer stud and said king stud.

5. The entry door frame of claim 3 wherein said anchor member has a cylindrical body with a tip and a head, said cylindrical body having a threaded portion and an unthreaded portion, said threaded portion extending from the tip of said anchor member to a location positioned within said trimmer stud.

6. The entry door frame of claim 5 wherein said anchor member has a threaded portion extending from adjacent said tip of said anchor member to a location in a mid-portion of said cylindrical body.

7. The entry door frame of claim 5 wherein said tip of said anchor member has a tip with bullnose shape.

8. The entry door frame of claim 5 wherein said head of said anchor member has an opening adapted to receive a screwing tool.

9. The entry door frame of claim 8 said head of said anchor member is beveled and said opening is adapted to receive a hex-sided head wrench.

10. The security strike plate of claim 1 wherein said inner side wall has an outer edge that is in substantial abutment with the lower surface of said ceiling.

11. The security strike plate of claim 1 wherein said ceiling, outer side wall, floor and inner side wall form an open ended substantially rectangular-shaped channel.

12. The entry door frame of claim 11 wherein said entry door frame is positioned within and attached to the wall framing of a building structure including a trimmer stud and a king stud adjacent thereto, and an elongated anchor member passing through said anchor member receiving openings in said ceiling and said floor of said security member portion and into and through said trimmer stud and into and through or substantially through said king stud, said anchor member being attached to at least one of said trimmer stud and said king stud.

* * * * *